US011462227B2

(12) United States Patent
Yang et al.

(10) Patent No.: US 11,462,227 B2
(45) Date of Patent: Oct. 4, 2022

(54) METHOD FOR DETERMINING DELAY BETWEEN SIGNALS, APPARATUS, DEVICE AND STORAGE MEDIUM

(71) Applicant: Apollo Intelligent Connectivity (Beijing) Technology Co., Ltd., Beijing (CN)

(72) Inventors: Danqing Yang, Beijing (CN); Gang Xu, Beijing (CN); Junhua Xu, Beijing (CN)

(73) Assignee: Apollo Intelligent Connectivity (Beijing) Technology Co., Ltd., Beijing (CN)

( * ) Notice: Subject to any disclaimer, the term of this patent is extended or adjusted under 35 U.S.C. 154(b) by 9 days.

(21) Appl. No.: 17/137,577

(22) Filed: Dec. 30, 2020

(65) Prior Publication Data

US 2021/0366503 A1 Nov. 25, 2021

(30) Foreign Application Priority Data

May 21, 2020 (CN) ..... 202010437931.3

(51) Int. Cl.

| | |
|---|---|
| ***G10L 21/0224*** | (2013.01) |
| ***G10L 21/04*** | (2013.01) |
| ***G10L 25/51*** | (2013.01) |
| *G10L 21/0208* | (2013.01) |

(52) U.S. Cl.

CPC ..... *G10L 21/0224* (2013.01); *G10L 21/04* (2013.01); *G10L 25/51* (2013.01); *G10L 2021/02082* (2013.01)

(58) Field of Classification Search

CPC ..... G10L 21/0224; G10L 21/04; G10L 25/51; G10L 2021/02082

USPC ..... 381/66

See application file for complete search history.

(56) References Cited

U.S. PATENT DOCUMENTS

2003/0174847 A1 9/2003 Lane et al.

OTHER PUBLICATIONS

Fowler R. et al. ("Enhancing Echo Cancellation via Estimation of Delay," IEEE Transactions on Signal Processing, IEEE Service Center, New York, NY, vol. 53, No. 11, Nov. 1, 2005, pp. 4159-4168) (Year: 2005).*

(Continued)

*Primary Examiner* — Paul Kim

(74) *Attorney, Agent, or Firm* — Hamess, Dickey & Pierce, P.L.C.

(57) ABSTRACT

The present application discloses a method for determining a delay between signals, an apparatus, a device and a storage medium, and relates to voice technology. In the method, apparatus, device, and storage medium provided by the present disclosure, by performing down-sampling processing on the signals, the amount of calculation for determining the delay can be reduced, thereby improving the determination efficiency. Moreover, signal segments including alignment positions of the two signals can be estimated in the signal through a currently determined delay, and then the processing can be performed again on the signal segments. In this way, a range for determination can be gradually reduced, that is, an accurate delay can be obtained by just processing shorter signals, which not only ensures the accuracy of the determination, but also reduces the amount of data processing.

20 Claims, 8 Drawing Sheets

(56) References Cited

OTHER PUBLICATIONS

Extended European Search Report for corresponding European application No. 20216586.6, dated May 20, 2021, 10 pages.
Lu, Youhong, et al.: "Enhancing Echo Cancellation via Estimation of Delay," IEEE Transactions on Signal Processing, vol. 53, No. 11, Nov. 2005, pp. 4159-4168.

* cited by examiner

METHOD FOR DETERMINING DELAY BETWEEN SIGNALS, APPARATUS, DEVICE AND STORAGE MEDIUM

CROSS-REFERENCE TO RELATED APPLICATIONS

This application claims priority to Chinese Patent Application No. 202010437931.3, filed on May 21, 2020, which is hereby incorporated by reference in its entirety.

TECHNICAL FIELD

The present disclosure relates to data processing technology, and particularly, to voice technology.

BACKGROUND

At present, a signal recorded by an electronic device through a microphone may include a reference signal. For example, when the electronic device plays audio, the microphone is also recording audio, and in this case, the microphone will record the audio played by the electronic device.

Therefore, when an electronic device processes a voice signal, it needs to perform echo cancellation processing. Specifically, the reference signal can be subtracted from the signal recorded by the microphone to obtain a clean signal. The reference signal refers to an audio signal being played by the electronic device.

In some scenarios, there will be a long delay between the signal recorded by the microphone and the reference signal. Therefore, it is necessary to estimate the delay between the recorded signal and the reference signal before performing echo cancellation processing. How to efficiently determine the delay between signals is a technical problem that those skilled in the art urgently need to solve.

SUMMARY

The present disclosure provides a method for determining a delay between signals, an apparatus, a device and a storage medium.

According to a first aspect, a method for determining a delay between signals is provided, including:

repeating following steps until each of preset sampling rates has been determined as a current sampling rate, where a first current signal at first is a recorded signal, and a second current signal at first is a reference signal:

determining a current sampling rate from the preset sampling rates, and processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal;

determining a target delay between the recorded signal and the reference signal according to the current delay corresponding to each current sampling rate.

According to a second aspect, an apparatus for determining a delay between signals is provided, including:

a loop module, configured to repeat following steps until each of preset sampling rates has been determined as a current sampling rate, where a first current signal at first is a recorded signal, and a second current signal at first is a reference signal:

determining a current sampling rate from the preset sampling rates, and processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal;

a determining module, configured to determine a target delay between the recorded signal and the reference signal according to the current delay corresponding to each current sampling rate.

According to a third aspect, an electronic device is provided, including:

at least one processor; and a memory communicatively connected with the at least one processor; where, the memory stores instructions executable by the at least one processor, and the instructions are executed by the at least one processor to enable the at least one processor to execute the method for determining a delay between signals as described in the first aspect.

According to a fourth aspect, a non-transitory computer-readable storage medium storing computer instructions is provided, the computer instructions are used to enable a computer to execute the method for determining a delay between signals as described in the first aspect.

According to a fifth aspect, another method for determining a delay between signals is provided, including:

repeating following steps until each of preset sampling rates has been determined as a current sampling rate, where a first current signal at first is a recorded signal, and a second current signal at first is a reference signal:

determining a current sampling rate from the preset sampling rates, and determining a current delay between the first current signal and the second current signal according to the current sampling rate; according to the current delay, determining a new first current signal corresponding to the first current signal, and determining a new second current signal corresponding to the second current signal;

determining a target delay between the recorded signal and the reference signal according to the current delay corresponding to each current sampling rate.

The present disclosure provides a method for determining a delay between signals, an apparatus, a device and a storage medium, including: repeating the following steps until each of preset sampling rates has been determined as a current sampling rate, where a first current signal at first is a recorded signal, and a second current signal at first is a reference signal: determining a current sampling rate from the preset sampling rates, processing the first current signal and the second current signal according to the current sampling rate; determining a current delay according to the processed first current signal and the processed second current signal; determining the first target signal and the second target signal in the first current signal and the second current signal, respectively, according to the current delay; determining the first target signal as the first current signal, and determining the second target signal as the second current signal; determining a target delay between the recorded signal and the reference signal according to the current delay corresponding to each current sampling rate.

BRIEF DESCRIPTION OF DRAWINGS

The accompanying drawings are used for better understanding of the solution and do not constitute a limitation to the present application, among them.

DESCRIPTION OF EMBODIMENTS

The exemplary embodiments of the present application are described below in conjunction with the accompanying drawings, which include various details of the embodiments of the present application to facilitate understanding, and they should be regarded as merely exemplary. Therefore, those of ordinary skill in the art should recognize that various changes and modifications can be made to the embodiments described herein without departing from the scope and spirit of the present application. Likewise, for clarity and conciseness, descriptions of well-known functions and structures are omitted in the following description.

Figure 1A:
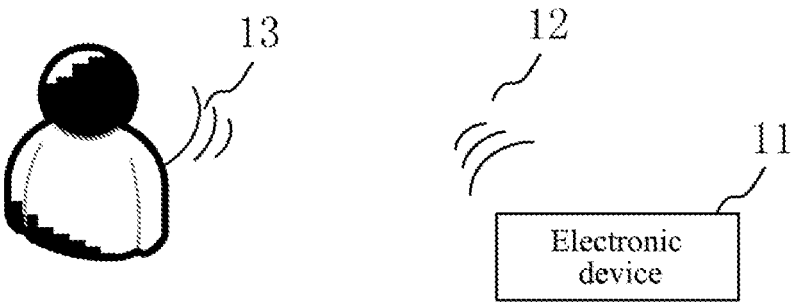
FIG. 1A is an application scenario diagram shown in an illustrative embodiment of the present application.

FIG. 1A is an application scenario diagram shown in an illustrative embodiment of the present application.

As shown in FIG. 1A, an electronic device 11 has an audio playback function and an audio signal collection function. For example, the electronic device is equipped with a microphone, which can record audio signals.

An audio signal played by the electronic device 11 is a signal 12, and an audio signal recorded by the electronic device may be, for example, a voice signal 13 spoken by a user. If the electronic device 11 records the audio signal 13 while playing the audio signal 12, it will record the audio signal 12 at the same time. In order to make the signal recorded by the electronic device more pure, the signal 12 needs to be removed from the recorded signal.

Since the electronic device 11 needs some time from receiving the audio signal 12 that needs to be played to playing it, there is a certain delay between the audio signal 12 played by the electronic device and the recorded audio signal 13, and a clean signal cannot be obtained by directly subtracting the signal to be played from the recorded signal.

Figure 1B:
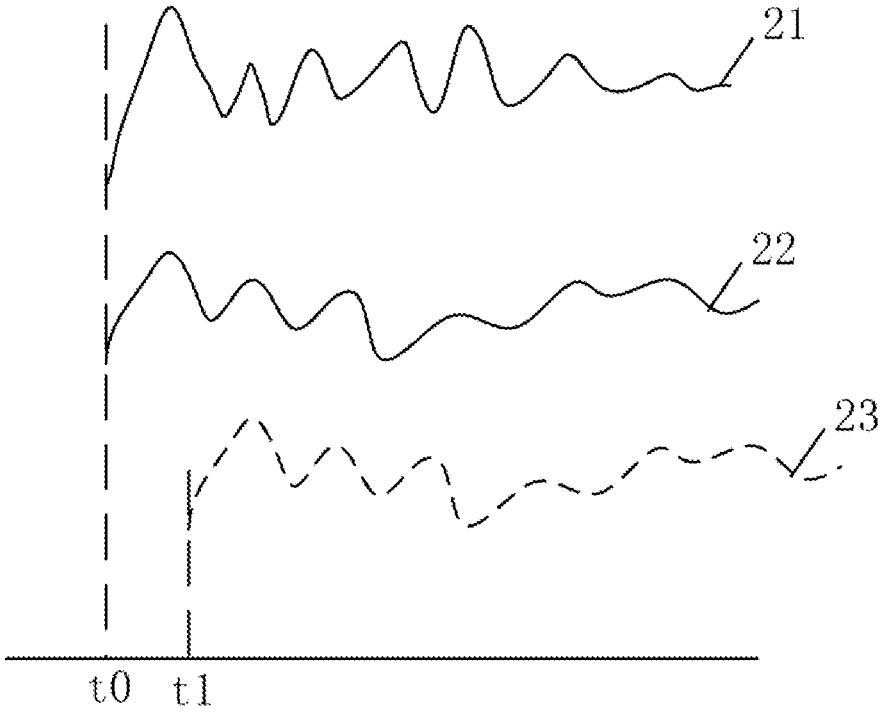
FIG. 1B is a schematic diagram of a recorded signal and a reference signal shown in an illustrative embodiment of the present application.

FIG. 1B is a schematic diagram of a recorded signal and a reference signal shown in an illustrative embodiment of the present application.

As shown in FIG. 1B, a recorded signal is 21, a reference signal is 22, a start time of the electronic device receiving the reference signal is t0, and a start time of recording a signal is also t0. The electronic device needs to perform a series of processing on the reference signal 22 before being able to play it. In this process, the time spent is (t1−t0), then the reference signal actually played is 23.

If the reference signal 22 is directly subtracted from the recorded signal 21, echoes in the recorded signal cannot be effectively eliminated since the playback time of the reference signal is inconsistent with the start time of recording the recorded signal. Therefore, the delay (t1−t0) between the recorded signal 21 and the reference signal 22 needs to be determined. The reference signal 22 can be adjusted to the state of the actually played reference signal 23 in timing according to the delay, and then an echo cancellation process is performed.

If a clean recorded audio signal needs to be obtained, the delay between the recorded signal and the played signal needs to be determined before the echo cancellation processing is performed. In an existing solution, a recorded signal and a played audio signal can be compared frame by frame to determine a time delay between the recorded signal and the played audio signal. However, this method is too computationally expensive, resulting in low efficiency in determining the time delay.

In the method for determining a delay between signals provided in the present application, the original recorded signal and the reference signal are down-sampled, and the delay of the two signals is preliminarily estimated based on the down-sampling signal, and based on the delay, target signals including aligned positions are estimated in the two signals, and the above steps are repeated on the target signals, thereby performing multiple times of down-sampling and estimating step by step, until a relatively accurate delay result is obtained.

Because the method provided by the present application performs down-sampling processing on the signals, the amount of calculation can be greatly reduced, and the target signals including aligned positions can be estimated in the two signals based on a current situation, and therefore it is possible to process only the target signals, thereby further reducing the amount of data processing while ensuring the accuracy, and thus improving the efficiency of delay determination.

After determining the time delay between the recorded signal and the reference signal, the electronic device can perform echo cancellation processing according to the determined time delay. Since the delay can be determined efficiently and accurately during determining the delay, the recorded sound can thus be processed efficiently and accurately.

Figure 2:
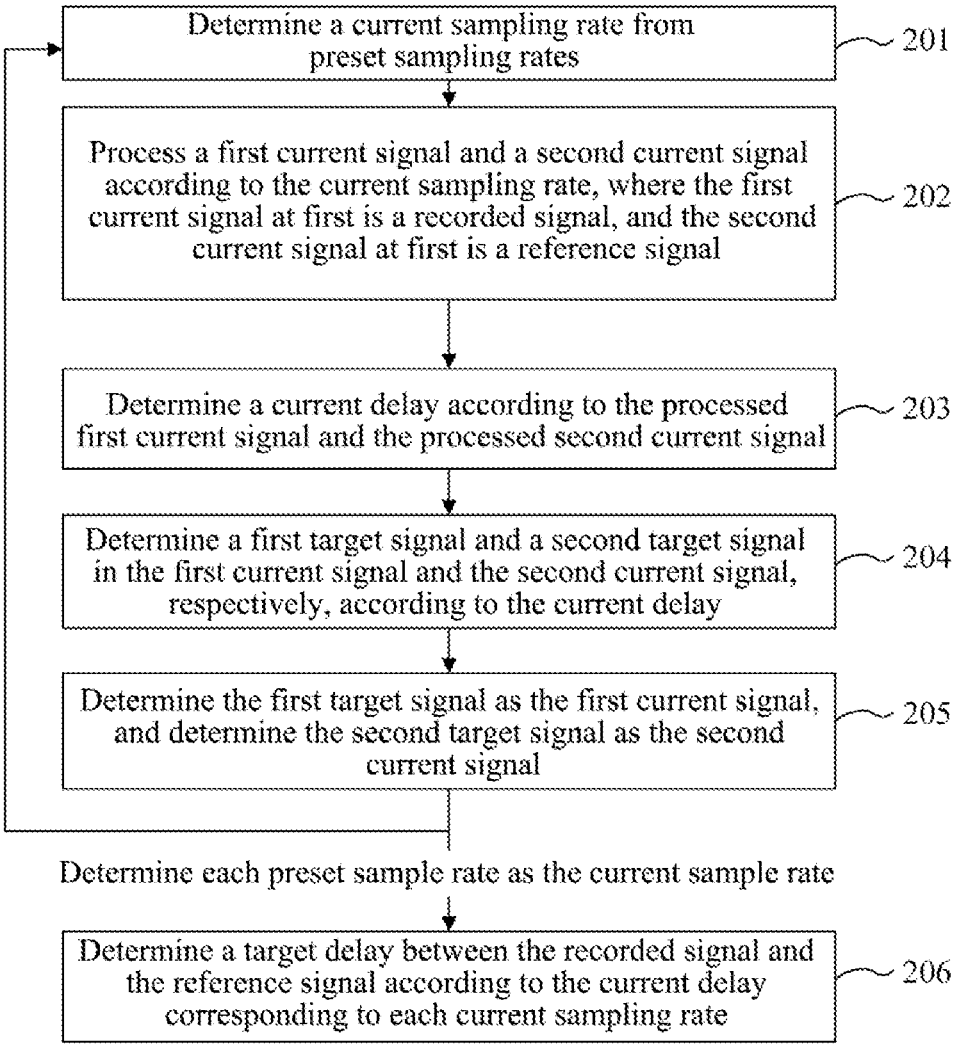
FIG. 2 is a flowchart of a method for determining a delay between signals according to an illustrative embodiment of the present application.

FIG. 2 is a flowchart of a method for determining a delay between signals according to an illustrative embodiment of the present application.

As shown in FIG. 2, the method for determining a delay between signals provided in the embodiment of the present application includes:

Step 201: Determine a current sampling rate from preset sampling rates.

The method provided in the present application can be executed by an electronic device with computing capabilities, for example, the electronic device 11 shown in FIG. 1.

Specifically, the electronic device 11 has an audio playback function and a recording function. For example, the electronic device 11 may be equipped with a speaker and a microphone at the same time t0 implement audio playback and recording functions, respectively. The electronic device may specifically be a mobile phone, a device for conducting a video conference or a telephone conference, a smart speaker, etc., which is not limited in this embodiment.

Furthermore, multiple levels of preset sampling rates can be set in advance, and the values of these preset sampling rates are different. For example, a set of preset sampling rates can be set as "½, ¼ . . . ½^n", where n can be set according to requirements.

In practical application, a sampling rate refers to a sampling frequency, and specifically, the number of samples per unit time. The reciprocal of the sampling rate is the sampling period. For example, the sampling rate is ½, which means that the number of samples per unit time is ½ and the sampling period is 2, that is, one sample is collected every two sampling periods.

A rule for determining a current sampling rate from the preset sampling rates can be pre-configured. For example, a smallest sampling rate is taken as the current sampling rate first, and then a larger sampling rate is taken as the current sampling rate.

Specifically, for example, ½^n is taken as the current sampling rate to perform the following steps. Then, ½^(n−1) is taken as the current sampling rate to perform the following steps, and so on, until all the preset sampling rates have been traversed.

Step 202: Process a first current signal and a second current signal according to the current sampling rate, where the first current signal at first is a recorded signal, and the second current signal at first is a reference signal.

Further, for clear description, the first current signal and the second current signal are defined in this embodiment. When step 202 is performed for the first time, the first current signal is a recorded signal, and the second current signal is a reference signal. When step 202 is performed again, they are the first current signal and the second current signal determined based on the following steps.

In actual application, the first current signal and the second current signal can be processed, respectively, according to the determined current sampling rate. Specifically, the two signals can be sampled.

When this step is performed for the first time, the recorded signal and the reference signal are processed, respectively, according to the current sampling rate. When step 202 is performed again, a determined first current signal and a determined second current signal are processed according to the current sampling rate.

Specifically, the first current signal and the second current signal can be sampled, respectively, by using the current sampling rate. Specifically, a sampling period can be determined according to the sampling rate, and a sample is collected in a signal every sampling period to obtain a sampled signal.

Figure 3:
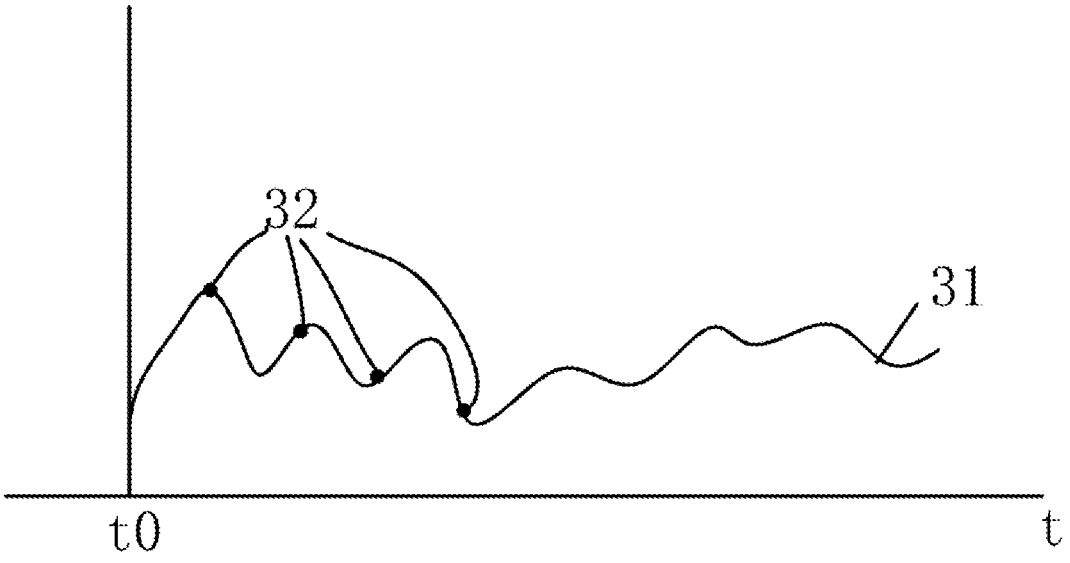
FIG. 3 is a schematic diagram of processing a current signal according to an illustrative embodiment of the present application.

FIG. 3 is a schematic diagram of processing a current signal according to an illustrative embodiment of the present application.

Further, the method of using the current sampling rate is similar for the first current signal and the second current signal, and this embodiment illustratively describes this process through FIG. 3.

As shown in FIG. 3, 31 is a current signal (the first current signal or the second current signal), which can be a function of time, that is, the horizontal axis is time and the vertical axis is amplitude of the signal.

In practical application, the current signal 31 can be sampled according to the sampling rate to obtain multiple samples 32. The collection of these samples 32 is the signal obtained after the current signal 31 is processed by using the current sampling rate.

The first current signal and the second current signal are respectively processed to obtain the processed first current signal and the processed second current signal. Since the first current signal and the second current signal are sampled, the amount of data included in the processed signals is significantly reduced. For example, the original current signals may include 10,000 pieces of data, and the processed current signal only includes 100 pieces of sample data.

Step 203: Determine a current delay according to the processed first current signal and the processed second current signal.

Specifically, after the first current signal and the second current signal have been sampled, the current delay can be determined according to the processed first current signal and the processed second current signal. Since the data included in the processed first current signal and the processed second current signal is less than that in the signals before processing, the amount of calculation generated by determining the delay based on the processed signals is lower than the amount of calculation generated by determining the delay based on the signals before processing.

Further, the processed signals are obtained by sampling the original signals, and therefore, the processed first current signal can reflect the characteristics of the first current signal, and the processed second current signal can reflect the characteristics of the second current signal. The current delay can be determined according to the processed first current signal and the processed second current signal.

In actual application, the current delay determined in the first loop iteration may be less accurate, but as the number of loop iterations increases, the determined delay result will become more accurate. In addition, the accuracy of the determined delay is also related to the sampling rate. In the method provided in this embodiment, a small sampling rate may be used in the first loop iteration, and the sampling rate is gradually increased as the number of loop iterations increases, so that not only the amount of data calculation can be reduced, but also the accuracy of the determined result can be ensured.

When determining the current delay, the processed first current signal may be compared with the processed second current signal. Since these two signals are signals obtained after sampling, the amount of data they contain will not very large, so the amount of data processing can be reduced and the efficiency of determining the delay can be improved.

Specifically, the processed first current signal and the processed second current signal can be compared frame by frame to determine the delay between the processed first current signal and the processed second current signal. For example, a starting position that includes the processed second current signal is determined in the processed first current signal, so as to determine the delay between the two. It is also possible to calculate cross-correlation energy values of the processed first current signal and the processed second current signal, and determine the delay of the two signals according to a position with a largest cross-correlation energy value.

Step 204: Determine a first target signal and a second target signal in the first current signal and the second current signal, respectively, according to the current delay.

Further, if there is a value in the preset sampling rate that has not been taken as the current sampling rate, step 204 may be performed. If each value in the preset sampling rate has been taken as the current sampling rate, and a corresponding current delay is determined according to each current sampling rate, steps 204-205 may not be performed, and instead, step 206 is performed directly.

In actual application, if all the preset sampling rates are not applied, it can be considered that the current delay can continue be determined according to the preset sampling rates to make the result more accurate.

The first target signal and the second target signal can be determined in the first current signal and the second current signal, respectively, according to the currently determined delay. It can be considered that the first target signal and the second target signal include alignment positions.

Specifically, in general, there is a time delay between the recorded signal and the reference signal caused by processing the reference signal. Suppose that a signal is recorded from time t0, and the electronic device receives the reference signal at time t0 and plays it. Since it is necessary to perform a series of processing on the reference signal to be able to play it, the start time of the actual played signal will be delayed from t0 to t1.

In this case, the reference signal needs to be moved back (t1−t0) in timing, to make the recorded signal and the actual playback reference signal be aligned in timing so that echo cancellation processing can be performed. In this case, it can be considered that because it takes time t0 process the reference signal, the starting position of the reference signal included in the recording signal lags behind the starting position of the recording signal, and the time difference between them needs to be found in the recording signal, which is the delay between the recording signal and the reference signal.

In this case, an alignment position can be determined in the first current signal according to the delay. For example, if the current delay is 5 ms, the position of 5 ms in the first current signal can be used as the alignment position, and then the first target signal is determined according to the alignment position. For example, a delay error can be determined according to the current sampling rate, so that the signals before and after the alignment position are used as the first target signal. For example, if the error is ±1 ms, the first target signal may be a segment of the first current signal from 4 ms to 6 ms. For the second current signal, starting from the starting position, a segment of the signal with the same length as the first target signal can be taken as the second target signal.

If in some cases, the starting position of the recorded signal lags behind the starting position of the actual recorded reference signal in timing, then an alignment position can be determined in the second current signal according to the delay, and the second target signal can be determined according to the alignment position. For the first current signal, starting from the starting position, a segment of the signal with the same length as the second target signal can be taken as the first target signal.

Further, according to this embodiment, it is possible to estimate the alignment positions of the recording signal and the reference signal in the first target signal and the second target signal, so that the two segments of signals can be processed to determine a more accurate delay. This method can eliminate signals that do not include the alignment positions, thereby greatly reducing the amount of data processing.

Figure 4:
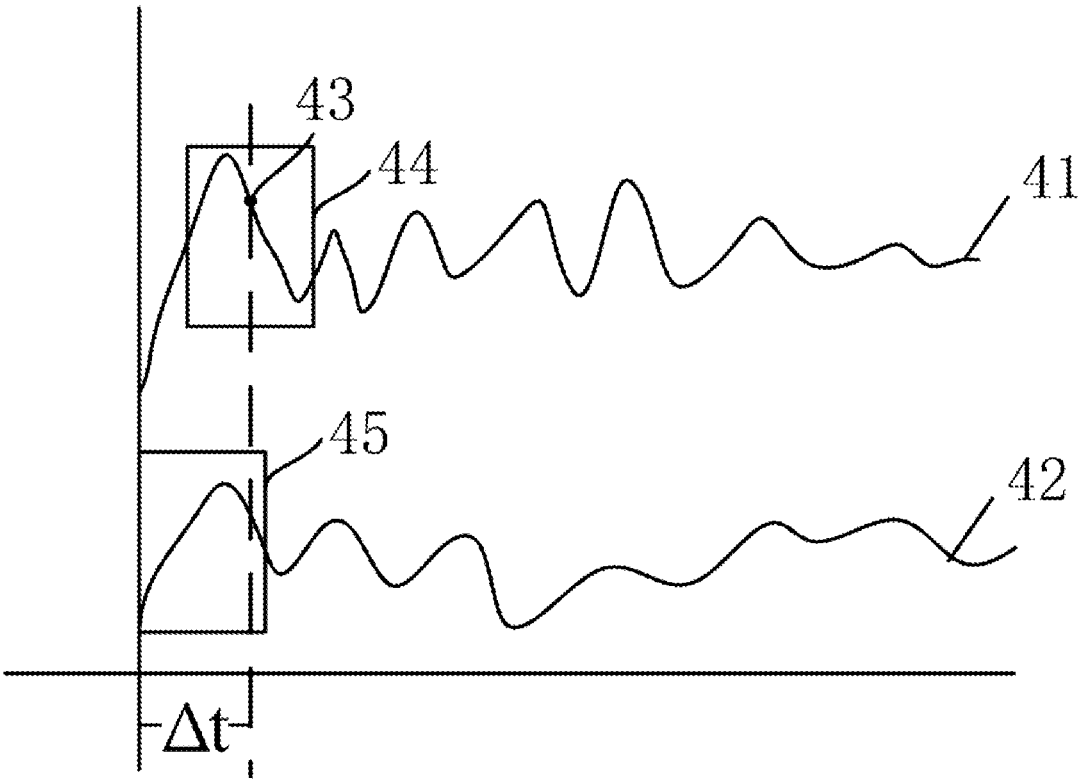
FIG. 4 is a schematic diagram of a first current signal and a second current signal shown in an illustrative embodiment of the present application.

FIG. 4 is a schematic diagram of a first current signal and a second current signal shown in an illustrative embodiment of the present application.

As shown in FIG. 4, 41 is the first current signal, 42 is the second current signal, and the determined current delay is Δt.

According to the current delay Δt, a possible alignment position 43 can be estimated in the first current signal 41, and a segment of the signal including the alignment position 43 can be taken as the first target signal 44. It can be considered that the first target signal should include the alignment position corresponding to the second current signal 42. A signal that starts from the starting position of the second current signal 42 and has the same length as the first target signal 44 can be taken as the second target signal 45. The two target signals 44 and 45 can be processed to determine a more accurate delay.

Since the first target signal 44 and the second target signal 45 are both determined in the current signals, the data therein is part of the original recording signal and reference signal. Specifically, the first target signal is part of the recorded signal, and the second target signal is part of the reference signal. Therefore, continuing to process these two target signals to determine the current delay is equivalent to processing the original recorded signal and reference signal to determine the delay. When the sampling rate gets higher and higher, the determined result will become more and more accurate without loss of accuracy.

Step 205: Determine the first target signal as the first current signal, and determine the second target signal as the second current signal.

The first target signal may be determined as the first current signal, and the second target signal may be determined as the second current signal, and step 201 continues to be performed.

The above steps are repeated until each preset sampling rate has been determined as the current sampling rate. In this way, the length of the first current signal and the second current signal can be gradually shortened, and thus a range for determination of the delay is gradually reduced, and the result is more and more accurate.

For example, at first the first current signal is a recording signal, and the second current signal is a reference signal. These two signals are relatively long, but they can be processed with a low sampling rate to reduce the amount of data processing.

After that, a current time delay can be determined, and the first target signal and the second target signal can be obtained. The length of these two signals is shorter than that of the recorded signal and the reference signal. A higher sampling rate can be used, and another current time delay with higher accuracy can be determined to obtain another first target signal and another second target signal.

These two signals are even shorter than the previous signals, and an even higher sampling rate can be used to process them, and another current delay with even higher accuracy can be determined to obtain further another first target signal and second target signal. By analogy, in this way, the length of the first current signal and the second current signal that need to be processed can be gradually shortened, and the accuracy of the determined result can be improved at the same time.

Step 206: Determine a target delay between the recorded signal and the reference signal according to the current delay corresponding to each current sampling rate.

By repeating the above steps, a corresponding current delay can be determined when each preset sampling rate is taken as the current sampling rate. Finally, an accurate target delay can be obtained according to the final delay determined each time.

Specifically, these current delays can be accumulated to obtain the target delay. For example, if the loop process is iterated three times, the current delay determined for the first iteration is 5 ms, the delay determined for the second iteration is −1 ms, and the delay determined for the third iteration is 0.5 ms, then these three values can be added to obtain that the target delay is 4.5 ms, and it can be considered that the reference signal lags behind the recorded signal by 4.5 ms.

After determining the target delay between the recorded signal and the reference signal, the two signals can be aligned, and then the reference signal can be subtracted from the recorded signal to obtain a clean signal to achieve the purpose of echo cancellation. In the method provided in this embodiment, since the delay can be determined efficiently and accurately during determining the delay, the recorded sound can be processed efficiently and accurately.

The method provided in the embodiment is used to determine the delay between signals. The method is executed by a device configured with the method provided in this embodiment, and the device is usually implemented in hardware and/or software.

The method for determining a delay between signals provided in the embodiment includes: repeating the following steps until each of preset sampling rates has been determined as a current sampling rate, where a first current signal at first is a recorded signal, and a second current signal at first is a reference signal: determining a current sampling rate from the preset sampling rates, processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal; determining a target delay between the recorded signal and the reference signal according to the current delay corresponding to each current sampling rate. In the method provided by the present application, by performing down-sampling processing on the signals, the calculation amount for determining the delay can be reduced, thereby improving the determination efficiency. Moreover, signal segments including the alignment positions of the two signals can be estimated in the signals through the currently determined delay, and then the above processing process can be performed again on the signal segments, and in this way, the range for determination can be gradually reduced. That is, an accurate delay can be obtained by just processing shorter signals, which not only ensures the accuracy of the determination, but also reduces the amount of data processing.

Figure 5:
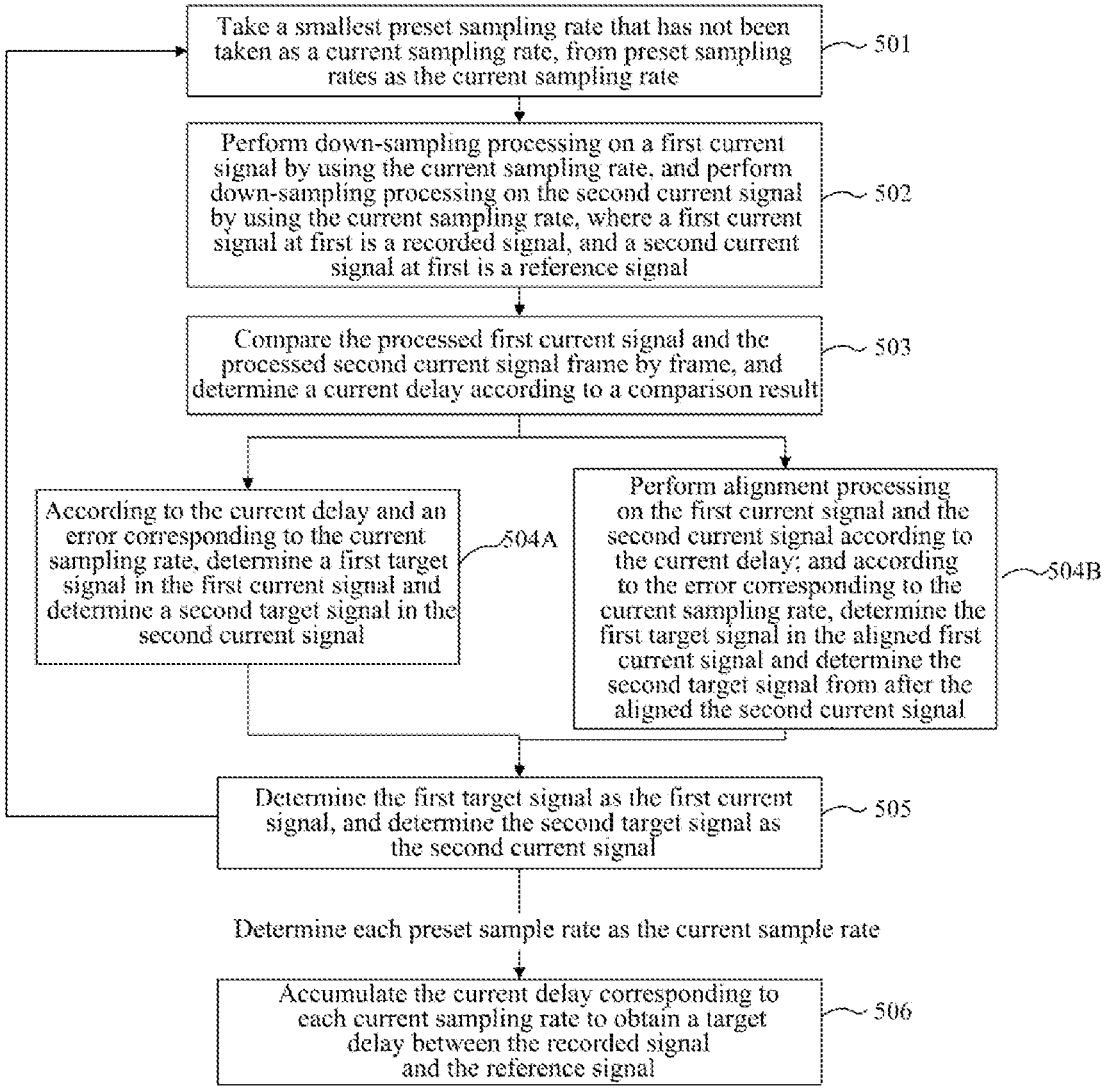
FIG. 5 is another flowchart of a method for determining a delay between signals according to an illustrative embodiment of the present application.

FIG. 5 is another flowchart of a method for determining a delay between signals according to an illustrative embodiment of the present application.

As shown in FIG. 5, the method for determining a delay between signals provided in the present application includes:

Step 501: Take a smallest preset sampling rate that has not been taken as a current sampling rate, from preset sampling rates as a current sampling rate.

The method provided in the present application can be executed by an electronic device with computing capabilities, for example, the electronic device 11 shown in FIG. 1.

Specifically, the electronic device 11 has an audio playback function and a recording function. For example, the electronic device 11 may be equipped with a speaker and a microphone at the same time t0 implement the audio playback and recording functions, respectively. The electronic device may specifically be a mobile phone, a device for conducting a video conference or a telephone conference, a smart speaker, etc., which is not limited in this embodiment.

Furthermore, multiple levels of preset sampling rates can be set in advance, and the values of these preset sampling rates are different. For example, a set of preset sampling rates can be set as "½, ¼ . . . ½^n", where n can be set according to requirements.

In actual application, sampling rates that have not been taken as the current sampling rate may be determined in the preset sampling rates, and the smallest value among these preset sampling rates may be determined as the current sampling rate.

When the electronic device executes the method provided in this embodiment, it will process the first current signal and the second current signal based on each preset sampling rate sequentially. When the first current signal and the second current signal are processed for the first time, the smallest preset sampling rate can be used, and when the first current signal and the second current signal are processed for the second time, the second smallest preset sampling rate can be used, and so on, until each preset sampling rate is used to process the first current signal and the second current signal.

For example, the preset sampling rates include 3 values, from small to large, n1, n2, and n3. Then, in the loop iteration process, the sampling rate used in the first loop iteration is n1, and the sampling rate used in the second loop iteration is n2, and the sampling rate used in the third loop iteration is n3. Thus, in the whole processing process, the sampling rate is increased step by step, thereby improving the accuracy of the determined result.

Step 502: Perform down-sampling processing on a first current signal by using the current sampling rate, and perform down-sampling processing on a second current signal by using the current sampling rate, where the first current signal at first is a recorded signal, and the second current signal at first is a reference signal.

For ease of description, the first current signal and the second current signal are defined in the embodiment of the present application. During a loop iteration, the first current signal and the second current signal are taken as objects to be processed.

Specifically, in the first loop iteration, the first current signal at first is the recorded signal, and the second current signal at first is the reference signal. That is, in the first loop iteration, the actual processed objects are the recorded signal and the reference signal.

Further, in subsequent loop iterations, the first current signal and the second current signal are determined based on the processing result.

In actual application, the first current signal and the second current signal are down-sampled using the determined current sampling rate, so that the length of the first current signal and the second current signal is shortened, leading to less data to be processed, and thereby improving the processing speed of determining the delay.

For example, if the first current signal includes 10,000 sampling points, that is, it includes 10,000 pieces of data, the down-sampling process is performed on the first current signal so that the down-sampled first current signal only includes 100 pieces of data, then the 100 pieces of data is processed, which can greatly reduce the amount of calculation compared with the processing of 10,000 pieces of data.

Step 503: Compare the processed first current signal and the processed second current signal frame by frame, and determine a current delay according to a comparison result.

The amount of data included in the processed first current signal and the second current signal is significantly reduced. At this time, the processed first current signal and the processed second current signal can be compared frame by frame, and the current delay can be determined based on the result of the comparison. The current delay refers to the delay between the first current signal and the second current signal determined based on the current sampling rate.

For example, in the first loop iteration, the first current signal is the recorded signal, and the second current signal is the reference signal, then the current delay determined based on the smallest preset sampling rate is a rough estimate of the delay between the recorded signal and the reference signal.

In the solution provided by the embodiment, when the amount of data included in the first current signal and the second current signal is relatively large, a low sampling rate is used to process them, and as the data amount of the first current signal and the second current signal is reduced, the sampling rate is increased. In this way, the amount of data processing can be reduced, and meanwhile the accuracy of the determined result can be ensured.

Specifically, by comparing the first current signal with the second current signal frame by frame, the starting position of the second current signal included in the first current signal can be found. For example, if initial content of the second current signal is contained in the first current signal at a position of 50 ms, then 50 ms can be taken as the current delay.

Furthermore, several consecutive frames of data in the two signals can be compared to estimate the delay between the two signals.

Optionally, after step 503, it can also be determined whether each preset sampling rate has been determined as the current sampling rate, if yes, step 506 can be performed, otherwise, step 504A or 504B can continue to be performed. This method can directly determine a target delay after the current delay is determined based on the last preset sampling rate, so that the step of determining the target signals is eliminated, thereby further improving the data processing speed.

Step 504A: According to the current delay and an error corresponding to the current sampling rate and determine a first target signal in the first current signal and determine a second target signal in the second current signal.

In an embodiment, after the corresponding current delay is determined based on the current sampling rate, the first target signal may be determined in the first current signal, and the second target signal may be determined in the second current signal.

If the sampling rate is different, the error of the determined delay will also be different. For example, the lower the sampling rate, the less the sample data collected from the current signal, and the greater the error in the determined current delay; the higher the sampling rate, the more the sample data collected from the current signal, and the smaller the error of the determined current delay. A range of the delay can be determined in the current signal according to the current delay and the error corresponding to the current sampling rate, thereby reducing the signal processing range.

Specifically, the error corresponding to each preset sampling rate, that is, the error of each current sampling rate, can be set. When the first target signal and the second target signal need to be determined, the error corresponding to the current sampling rate can be directly read.

Further, a first position may be determined in the first current signal according to the current delay, and the first target signal may be determined according to the first position and the error corresponding to the current sampling rate.

Figure 6:
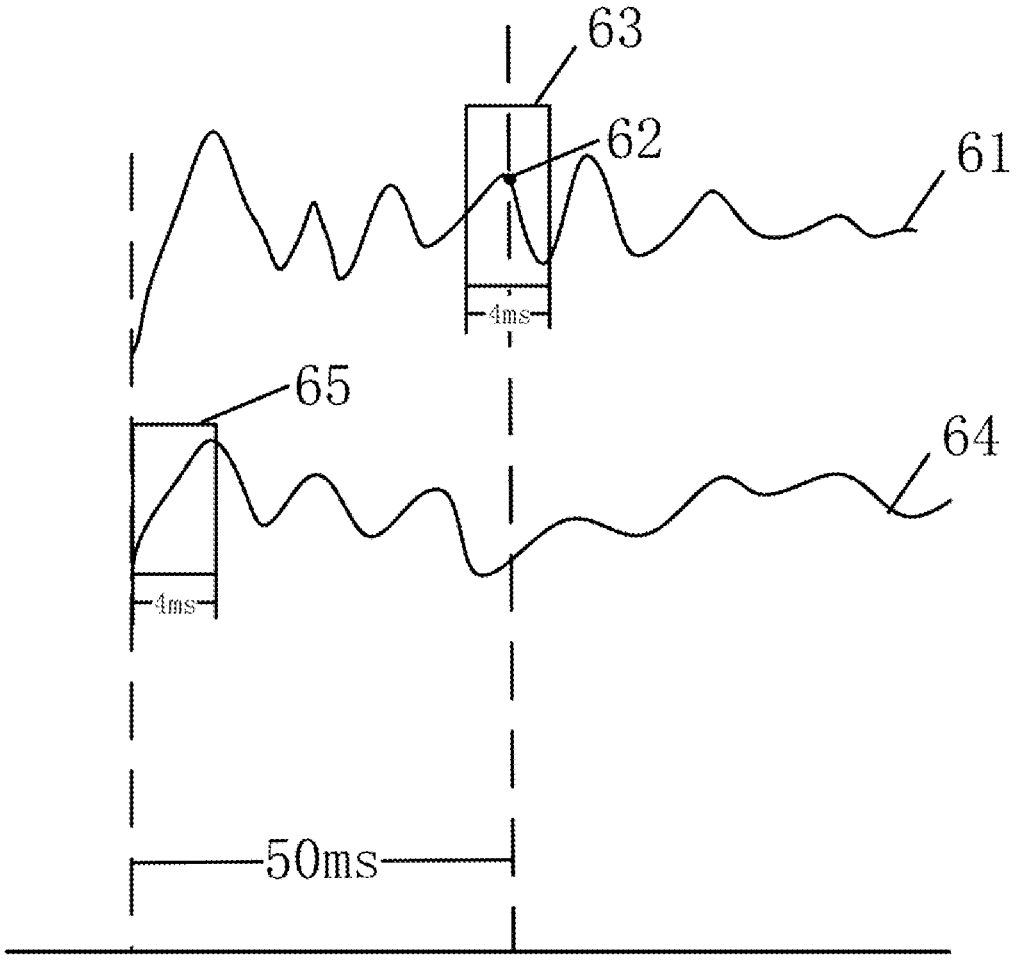
FIG. 6 is a schematic diagram of determining a first target signal and a second target signal shown in an illustrative embodiment of the present application.

FIG. 6 is a schematic diagram of determining a first target signal and a second target signal shown in an illustrative embodiment of the present application.

As shown in FIG. 6, suppose that in a recorded signal, a starting position of an actually recorded reference signal lags behind a starting position of the recorded signal. Then a first position 62 can be determined in a first current signal 61 according to a current delay. Then, according to an error corresponding to a current sampling rate, a first target signal including the first position 62 is determined. For example, if the current delay is 50 ms, the position of 50 ms of the first current signal 61 is determined as the first position 62, and for example, the error is ±2 ms, and then a segment of signal from 48 ms to 52 ms can be taken as the first target signal 63.

In this embodiment, since the current sampling rate corresponds to an error value which is relatively large especially when the current sampling rate is small, therefore a specific range of the delay can be determined according to the roughly estimated current delay and the error value, thereby reducing the range of processed signals. For example, in the above-mentioned embodiment, it can be considered that the delay is within the range of 48 ms-52 ms, then in the subsequent processing, only this segment of signal may be processed, which can significantly reduce the amount of data processing.

A target length of time may also be determined according to the error corresponding to the sampling rate, and a signal that starts from the starting position of the second current signal and that has a length being the target length of time may be determined as the second target signal.

Please continue to refer to FIG. 6, assuming that in the recorded signal, the starting position of the actual recorded reference signal lags behind the starting position of the recorded signal, then the target length of time can be determined according to the error corresponding to the sampling rate, and for example, the error is ±2 ms and then the target length of time can be 4 ms, and the signal of 4 ms at the front of the second current signal 64 can be taken as the second target signal 65.

If it is considered that the recorded signal contains the reference signal from a certain position of the recorded signal, then the delay between the two signals can be determined as long as the starting position of the recorded signal included in the reference signal is determined. Therefore, in this embodiment of the present application, a range of the first target signal can be estimated in the first current signal, and a start signal segment of the second current signal can be used as the second target signal, and then both are processed, so that the starting position of the second target signal is determined in the first target signal, so as to determine a more accurate current delay.

Assuming that the starting position of the recorded signal lags behind the starting position of the actually played reference signal, then a second position can be determined in the second current signal according to the current delay. Then, according to the error corresponding to the current sampling rate, the second target signal including the second position is determined. The target length of time can also be determined according to the error corresponding to the sampling rate, and the signal segment that has a length being the target length of time and located at the very front of the first current signal can be taken as the first target signal.

Step 504B: Perform alignment processing on the first current signal and the second current signal according to the current delay; and according to the error corresponding to the current sampling rate, determine the first target signal in the aligned first current signal and determine the second target signal in the aligned the second current signal.

In another implementation, after the current delay is determined, the first current signal and the second current signal can be aligned first based on the current delay.

Similar to the foregoing embodiment, in this embodiment, errors corresponding to preset sampling rates are also preset.

After the signals are aligned, according to the error corresponding to the current sampling rate, the first target signal can be determined from the aligned first current signal, and the second target signal can be determined from the aligned second current signal.

Figure 7:
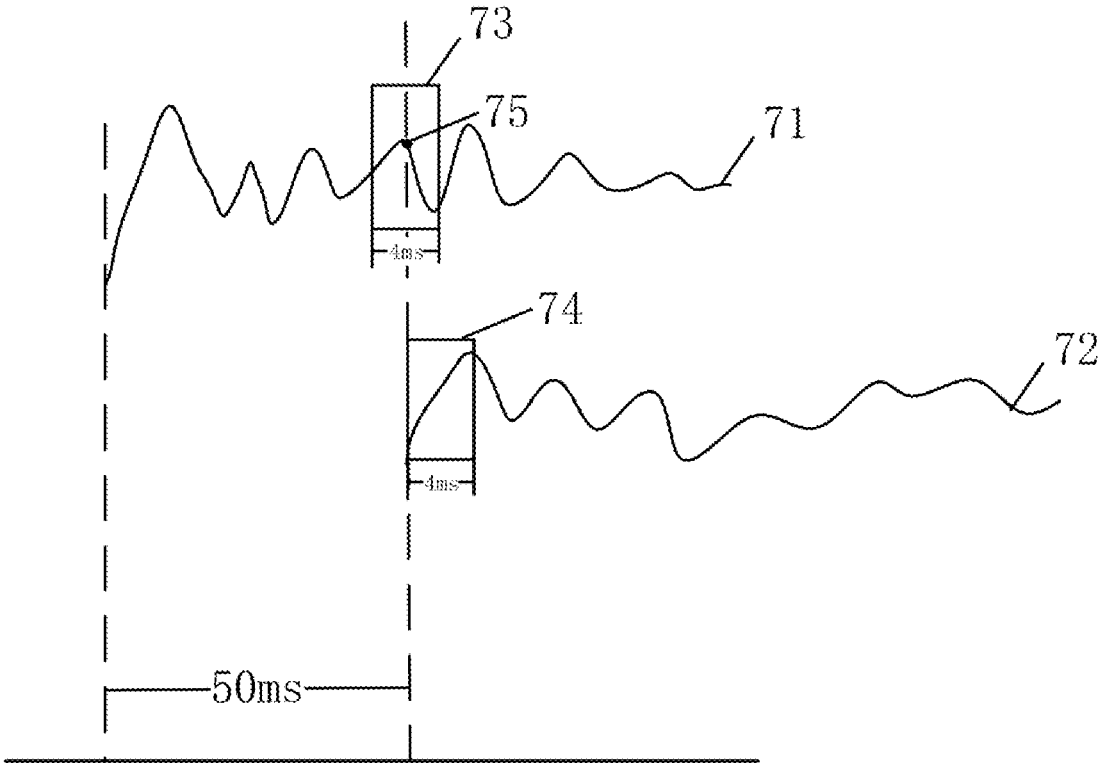
FIG. 7 is another schematic diagram of determining a first target signal and a second target signal shown in an illustrative embodiment of the present application.

FIG. 7 is another schematic diagram of determining a first target signal and a second target signal shown in an illustrative embodiment of the present application.

As shown in FIG. 7, assuming that in the recorded signal, the starting position of the recorded reference signal lags behind the starting position of the recorded signal itself, then based on the current delay, the first current signal or the second current signal can be adjusted to align the two. For example, if the current delay is 50 ms, the second current signal can be moved backward by 50 ms, so that the starting position of the second current signal is aligned with the starting position of the second current signal included in the first current signal. Or, the first current signal can be moved forward by 50 ms, so that the starting position of the second current signal is aligned with the start position of the second current signal included in the first current signal.

Please refer to FIG. 7, assuming that the second current signal is moved backward, then the aligned first current signal 71 and second current signal 72 can be obtained.

Since the determined current delay still has a certain error, the initial data of the first current signal may not necessarily include the initial data of the second current signal, and a signal range can be determined based on the error to reduce a length of data that needs to be processed.

Referring to FIG. 7, according to the error corresponding to the current sampling rate, the first target signal 73 can be determined in the aligned first current signal, and the second target signal 74 can be determined in the aligned second current signal.

The starting point alignment position 75 can be determined in the aligned first current signal, and the first target signal 73 can be determined according to the starting point alignment position and the error corresponding to the sampling rate. For example, the current delay is 50 ms, and then the starting point alignment position 75 may be the position of 50 ms of the first current signal. For example, the error is ±2 ms, and then a segment of signal of 50±2 ms can be taken as the first target signal 73.

Specifically, a target length of time can also be determined according to the error corresponding to the sampling rate. For example, the error is ±2 ms, and then the target length of time is 4 ms, and a signal that stars from the starting position of the second current signal and that has a length being the target length of time can be determined as the second target signal 74.

Further, compared to the original current signals, the determined target signals have a significantly shorter length, and the target signals include the alignment positions of the two signals. Therefore, the processing can be performed only based on the shortened target signals, so that the delay can be determined more and more accurately and the amount of data processing can be reduced.

Step 505: Determine the first target signal as the first current signal, and determine the second target signal as the second current signal.

Step 501 can continue to be performed according to the new first current signal and second current signal.

Optionally, it can also be determined whether each preset sampling rate has been taken as the current sampling rate, if so, step 506 can be performed, otherwise, step 501 can continue to be performed.

In the method provided in this embodiment, step 506 may be performed after step 505 or after step 503, which can be specifically set according to requirements.

Step 506: Accumulate the current delay corresponding to each current sampling rate to obtain a target delay between the recorded signal and the reference signal.

Specifically, based on the foregoing implementation, a corresponding current delay can be determined for each current sampling rate, and the current delays can be accumulated to obtain the target delay.

Furthermore, as the number of loop iterations increases, the length of the signals to be processed becomes shorter, the sampling rate becomes higher, and the accuracy becomes higher. By combining the multiple determined current delays, the amount of data processing can be reduced and the accuracy of the determined result can be ensured.

After the target delay is determined, echo cancellation processing can continue to be performed to the recorded signal according to the target delay.

In actual application, in an optional implementation, after the current delay is determined each time, it can also be determined whether the current delay is accurate, and if it is accurate, the step of determining the first target signal and the second target signal can be performed. If it is inaccurate, the current delay can continue to be determined, so as to avoid the problem that the determined target delay is inaccurate caused by inaccuracy of the determined current delay.

The specific method for determining whether the delay is accurate can be an existing technical solution.

Figure 8:
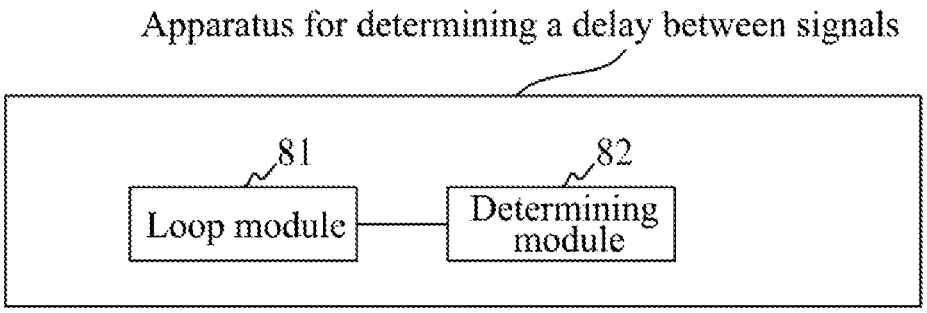
FIG. 8 is a structural diagram of an apparatus for determining a delay between signals according to an illustrative embodiment of the present application.

FIG. 8 is a structural diagram of an apparatus for determining a delay between signals according to an illustrative embodiment of the present application.

As shown in FIG. 8, the apparatus for determining a delay between signals provided in the present application includes:

a loop module 81, configured to repeat the following steps until each of preset sampling rates has been determined as a current sampling rate, where a first current signal at first is a recorded signal, and a second current signal at first is a reference signal:

determining a current sampling rate from the preset sampling rates, processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determine the second target signal as the second current signal;

a determining module 82, configured to determine a target delay between the recorded signal and the reference signal according to the current delay corresponding to each current sampling rate.

The apparatus for determining a delay between signals provided in this embodiment includes: a loop module, configured to repeat the following steps until each of preset sampling rates is determined as a current sampling rate, where a first current signal at first is a recorded signal, and a second current signal at first is a reference signal: determining a current sampling rate from the preset sampling rates, processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal; and a determining module, configured to determine a target delay between the recorded signal and the reference signal according to the current delay corresponding to each current sampling rate. In the apparatus provided by the present application, by performing down-sampling processing on the signals, the calculation amount for determining the delay can be reduced, thereby improving the determination efficiency. Moreover, signal segments including the alignment positions of the two signals can be estimated in the signals through the currently determined delay, and then the above processing process can be performed again on the signal segments, which can gradually reduce the range for determination. That is, an accurate delay can be obtained by just processing shorter signals, which not only ensures the accuracy of the determination, but also reduces the amount of data processing.

Figure 9:
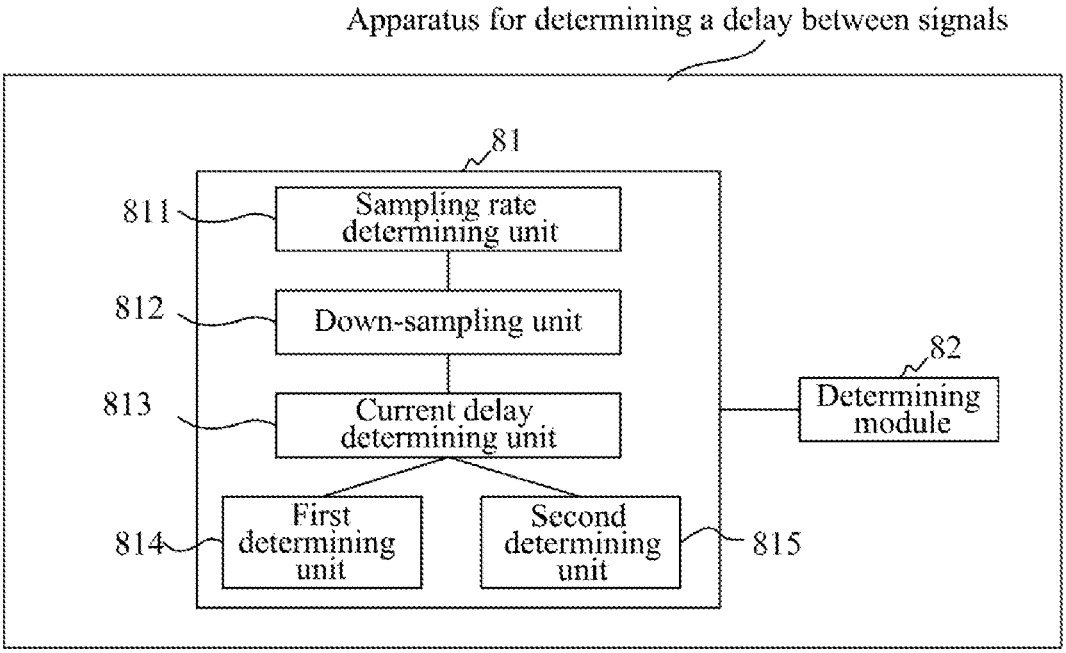
FIG. 9 is a structural diagram of an apparatus for determining a delay between signals according to another illustrative embodiment of the present application.

FIG. 9 is a structural diagram of an apparatus for determining a delay between signals according to an illustrative embodiment of the present application.

As shown in FIG. 9, on the basis of the foregoing embodiment, the apparatus for determining a delay between signals provided in this embodiment includes:

the loop module 81 includes a sampling rate determining unit 811, configured to:

take a smallest preset sampling rate that has not been taken as the current sampling rate from the preset sampling rates as the current sampling rate.

Optionally, the loop module 81 includes a down-sampling unit 812, configured to:

perform down-sampling processing on the first current signal by using the current sampling rate; and perform down-sampling processing on the second current signal by using the current sampling rate.

The loop module 81 includes a current delay determining unit 813, configured to:

compare the processed first current signal and the processed second current signal frame by frame, and determine the current delay according to a comparison result.

Optionally, the loop module 81 is further configured to:

when the current delay is accurate, perform the step of determining the first target signal and the second target signal in the first current signal and the second current signal, respectively, according to the current delay.

The loop module 81 is further configured to:

when the current delay is inaccurate, continue to perform the step of comparing the processed first current signal and the processed second current signal frame by frame and determining the current delay according to the comparison result.

The loop module 81 includes:

a first determining unit 814, configured to, according to the current delay and an error corresponding to the current sampling rate, determine the first target signal in the first current signal and determine the second target signal in the second current signal.

Optionally, the first determining unit 814 is specifically configured to:

determine a first position in the first current signal according to the current delay, and determine the first target signal according to the first position and the error corresponding to the current sampling rate;

determine a target length of time according to the error corresponding to the sampling rate, and determine a signal that starts from a starting position of the second current signal and that has a length being the target length of time as the second target signal.

The loop module 81 includes a second determining unit 815, configured to:

perform alignment processing on the first current signal and the second current signal according to the current delay;

according to the error corresponding to the current sampling rate, determine the first target signal in the aligned first current signal, and determine the second target signal in the aligned second current signal.

Optionally, the second determining unit 815 is specifically configured to:

determine a starting point alignment position in the aligned first current signal, and determine the first target signal according to the starting point alignment position and the error corresponding to the sampling rate;

determine a target length of time according to the error corresponding to the sampling rate, and determine a signal that from a start position of the second current signal and has a length being the target length of time as the second target signal.

Optionally, the determining module 82 is specifically configured to:

perform accumulation processing on the current delay corresponding to each current sampling rate to obtain the target delay between the recorded signal and the reference signal.

After determining the current delay according to the processed first current signal and the processed second current signal, the loop module 81 is further configured to:

if each of the preset sampling rates has been determined as the current sampling rate, perform the step of determining the target delay between the recorded signal and the reference signal according the current delay corresponding to each current sampling rate;

if each of the preset sampling rates has not been determined as the current sampling rate, perform the step of determining the first target signal and the second target signal in the first current signal and the second current signal, respectively, according to the current delay.

According to the embodiments of the present application, the present application also provides an electronic device and a readable storage medium.

Figure 10:
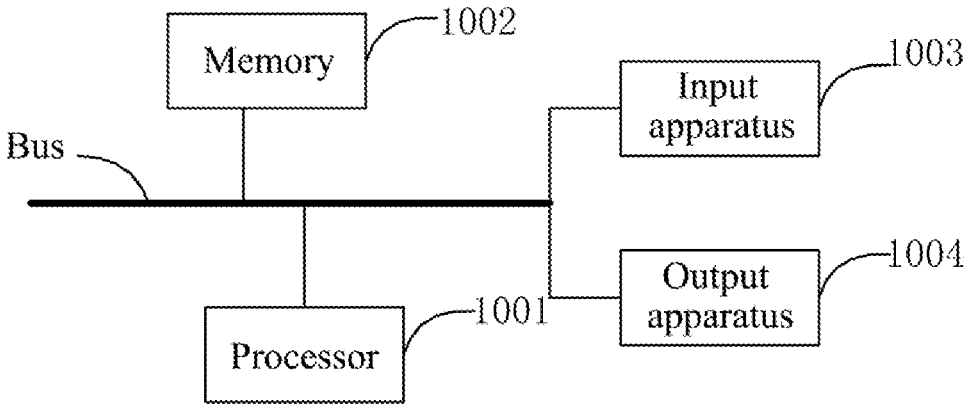
FIG. 10 is a structural diagram of an electronic device shown in an illustrative embodiment of the present application.

As shown in FIG. 10, it is a block diagram of an electronic device according to an embodiment of the present application. The electronic device is intended to represent various forms of digital computers, such as a laptop computer, a desktop computer, a workstation, a personal digital assistant, a server, a blade server, a mainframe computer, and other suitable computers. The electronic device can also represent various forms of mobile devices, such as a personal digital assistant, a cellular phone, a smart phone, a wearable device, and other similar computing devices. The components shown herein, their connections and relationships, and their functions are merely examples, and are not intended to limit the implementation of the application described and/or required herein.

As shown in FIG. 10, the electronic device includes: one or more processors 1001, a memory 1002, and interfaces for connecting various components, including a high-speed interface and a low-speed interface. Various components are connected to each other by using different buses, and can be installed on a common motherboard or installed in other ways according to requirements. The processor can process instructions executed in the electronic device, including instructions stored in or on the memory to display graphical information of a GUI on an external input/output device (such as a display device coupled to an interface). In other embodiments, if needed, multiple processors and/or multiple buses may be used with multiple memories. Similarly, multiple electronic devices can be connected, and each device provides some necessary operations (for example, as a server array, a group of blade servers, or a multi-processor system). In FIG. 10, one processor 1001 is taken as an example.

The memory 1002 is a non-transitory computer-readable storage medium provided by the present application, where the memory stores instructions executable by at least one processor, so that the at least one processor executes the method for determining a delay between signals provided in the present application. The non-transitory computer-readable storage medium of the present application stores computer instructions, and the computer instructions are used to cause the computer to execute the method for determining a delay between signals provided in the present application.

As a non-transitory computer-readable storage medium, the memory 1002 can be used to store non-transitory software programs, non-transitory computer executable programs, and modules, such as program instructions or modules corresponding to the method for determining a delay between signals in the embodiments of the present application (for example, the loop module 81 and the determining module 82 shown in FIG. 8). The processor 1001 runs non-transient software programs, instructions, and modules stored in the memory 1002 to execute various functional applications and data processing, that is, to implement the method for determining a delay between signals in the above method embodiments.

The memory 1002 can include a program storage area and a data storage area. The program storage area may store an operating system and an application program required for at least one function; the data storage area may store data created according to the use of an electronic device. In addition, the memory 1002 can include a high-speed random-access memory, and also include a non-transitory memory, for example, at least one magnetic disk storage device, a flash memory device, or other non-transitory solid-state storage devices. In some embodiments, the memory 1002 can optionally include memories remotely provided with respect to the processor 1001, and these remote memories may be connected to the electronic device through a network. Examples of the aforementioned networks include, but are not limited to, the Internet, a corporate intranet, a local area network, a mobile communication network, and a combination thereof.

The electronic device may further include: an input apparatus 1003 and an output apparatus 1004. The processor 1001, the memory 1002, the input apparatus 1003, and the output apparatus 1004 may be connected through a bus or other methods. In FIG. 10, the connection through a bus is taken as an example.

The input apparatus 1003 can receive input digital or character information, and generate key signal input related to user settings and function control of the electronic device, for example, a touch screen, a keypad, a mouse, a trackpad, a touchpad, a pointer, one or more mouse buttons, a trackball, a joystick and other input apparatus. The output apparatus 1004 can include a display device, an auxiliary lighting apparatus (for example, an LED), a tactile feedback apparatus (for example, a vibration motor), and the like. The display device may include, but is not limited to a liquid crystal display (LCD), a light emitting diode (LED) display, and a plasma display. In some embodiments, the display device may be a touch screen.

Various implementations of the systems and technologies described herein can be implemented in digital electronic circuit systems, integrated circuit systems, application specific ASICs (application specific integrated circuits), computer hardware, firmware, software, and/or combinations thereof. These various embodiments can include: being implemented in one or more computer programs, the one or more computer programs may be executed and/or interpreted on a programmable system including at least one programmable processor, and the programmable processor is a dedicated or general-purpose programmable processor, which can receive data and instructions from a storage system, at least one input apparatus, and at least one output apparatus, and transmit the data and instructions to the storage system, the at least one input apparatus, and the at least one output apparatus.

These computing programs (also called programs, software, software applications, or codes) include machine instructions for a programmable processor, and can utilize a high-level procedure and/or object-oriented programming language, and/or an assembly/machine language to implement these calculation procedures. As used herein, the terms "machine-readable medium" and "computer-readable medium" refer to any computer program product, device, and/or apparatus (for example, a magnetic disk, an optical disk, a memory, a programmable logic device (PLD)) used to provide machine instructions and/or data to a programmable processor, including machine-readable media that receive machine instructions as machine-readable signals. The term "machine-readable signal" refers to any signal used to provide machine instructions and/or data to a programmable processor.

In order to provide interaction with a user, the system and technology described here can be implemented on a computer with: a display apparatus for displaying information to the user (for example, CRT (Cathode Ray Tube) or LCD (Liquid Crystal Display)) Monitor); and a keyboard and a pointing apparatus (for example, a mouse or a trackball)

through which the user can provide input to the computer. Other types of apparatus can also be used to provide interaction with the user; for example, the feedback provided to the user can be any form of sensing feedback (for example, visual feedback, auditory feedback, or tactile feedback); and can be in any form (including acoustic input, voice input, or tactile input) to receive input from the user.

The systems and technologies described here can be implemented in a computing system that includes a back-end component (for example, as data servers), or a computing system that includes a middleware component (for example, an application server), or a computing system that includes a front-end component (for example, a user computer with a graphical user interface or a web browser through which the user can interact with the implementation of the system and technology described herein), or a computing system that includes any combination of such background component, intermediate component, or front-end components. The components of the system can be connected to each other through any form or medium of digital data communication (for example, a communication network). Examples of the communication network include: a local area network (LAN), a wide area network (WAN), and the Internet.

The computer system can include a client and a server. The client and server are generally far away from each other and usually interact through a communication network. The relationship between the client and the server is generated by computer programs running on the corresponding computers and having a client-server relationship with each other.

Figure 11:
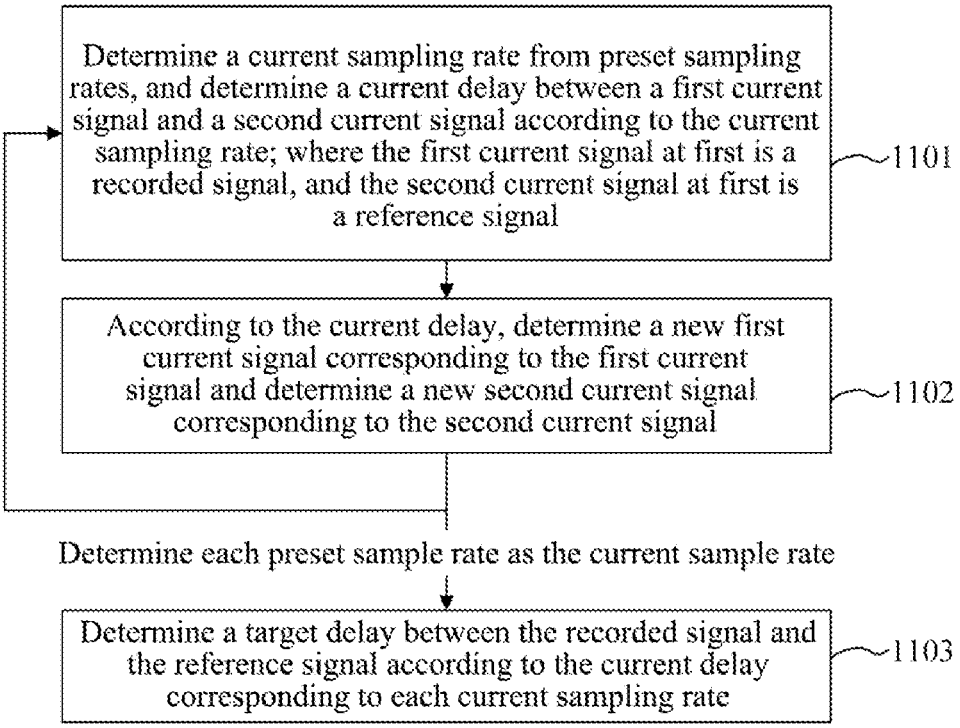
FIG. 11 is a flowchart of a method for determining a delay between signals according to a third illustrative embodiment of the present application.

FIG. 11 is a flowchart of a method for determining a delay between signals according to a third example embodiment of the present application;

As shown in FIG. 11, the method for determining a delay between signals provided in the present application includes:

Step 1101: Determine a current sampling rate from preset sampling rates, and determine a current delay between a first current signal and a second current signal according to the current sampling rate; where the first current signal at first is a recorded signal, and the second current signal at first is a reference signal.

The method provided in the present application can be executed by an electronic device with computing capabilities, for example, the electronic device 11 shown in FIG. 1.

Specifically, the electronic device 11 has an audio playback function and a recording function. For example, the electronic device 11 may be equipped with a speaker and a microphone at the same time t0 implement the audio playback and recording functions, respectively. The electronic device can specifically be a mobile phone, a device for conducting a video conference or a telephone conference, a smart speaker, etc., which is not limited in this embodiment.

Furthermore, multiple levels of preset sampling rates can be preset, and the values of these preset sampling rates are different. A rule for determining the current sampling rate from the preset sampling rates can be pre-configured. For example, first, a smallest sampling rate is taken as the current sampling rate, and then a larger sampling rate is taken as the current sampling rate.

For example, when step 1101 is performed for the first time, the smallest preset sampling rate is taken as the current sampling rate, and when step 1101 is performed for the second time, the second smallest preset sampling rate is taken as the current sampling rate, and so on.

The current signals can be processed according to the current sampling rate, thereby shortening the length of the signals. When step 1102 is performed, the amount of data processing can be effectively reduced.

In practical application, when step 1101 is performed for the first time, the first current signal is the recorded signal, and the second current signal is the reference signal. When step 1101 is performed again, the first current signal and the second current signal are determined based on the following steps.

Step 1102: According to the current delay, determine a new first current signal corresponding to the first current signal, and determine a new second current signal corresponding to the second current signal.

In actual application, according to the current delay, the new first current signal corresponding to the first current signal can be determined, and the new second current signal corresponding to the second current signal can be determined.

The determined new first current signal is part of the first current signal, and the new second current signal is part of the second current signal. In the new first current signal and the new second current signal, the alignment positions of the recorded signal and the reference signal are included. In this way, part of the original data that do not include the alignment positions can be eliminated, thereby the amount of data processing can be reduced effectively.

In an implementation, the first target signal and the second target signal can be determined in the first current signal and the second current signal, respectively, according to the current delay, and then the first target signal is taken as the new first current signal, the second target signal is taken as the new second current signal. And step 1101 continues to be performed.

After step 1102, step 1101 can continue to be performed according to the new first current signal and the new second current signal, until each preset sampling rate has been determined as the current sampling rate.

Step 1103: Determine a target delay between the recorded signal and the reference signal according to the current delay corresponding to each current sampling rate.

By repeating the above steps, when each preset sampling rate is taken as the current sampling rate, a corresponding current delay can be determined. Finally, an accurate target delay can be obtained according to the final delay determined each time.

Specifically, these current delays can be accumulated to obtain the target delay. For example, if the loop is iterated three times, the current delay determined for the first iteration is 5 ms, the delay determined for the second iteration is −1 ms, and the delay determined for the third iteration is 0.5 ms, these three values can be added to obtain that the target delay is 4.5 ms. It can be considered that the reference signal lags behind the recorded signal by 4.5 ms.

After determining the target delay between the recorded signal and the reference signal, the two signals can be aligned, and then the reference signal can be subtracted from the recorded signal to obtain a clean signal to achieve the purpose of echo cancellation. In the method provided in this embodiment, since the delay can be determined efficiently and accurately during determining the delay, the recorded sound can be processed efficiently and accurately.

It should be understood that the various forms of processes shown above can be used to reorder, add or delete steps. For example, the steps described in the present application can be performed in parallel, sequentially, or in a different order, as long as the desired result of the technical solution disclosed in the present application can be achieved, this is not limited herein.

The above specific implementations do not constitute a limitation on the protection scope of the present application. Those skilled in the art should understand that various modifications, combinations, sub-combinations and substitutions can be made according to design requirements and other factors. Any amendments, equivalent substitutions and improvements made within the spirit and principles of this application shall be included in the protection scope of this application.

What is claimed is:

1. A method for determining a delay between signals, comprising:

repeating following steps until each of preset sampling rates has been determined as a current sampling rate, wherein a first current signal at first is a recorded signal, and a second current signal at first is a reference signal:

determining a current sampling rate from the preset sampling rates, and processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal; and determining a target delay between the recorded signal and the reference signal according to the current delay corresponding to each current sampling rate.

2. The method according to claim 1, wherein the determining a current sampling rate from the preset sampling rates comprises:

taking a smallest preset sampling rate that has not been taken as the current sampling rate from the preset sampling rates as the current sampling rate.

3. The method according to claim 1, wherein the processing a first current signal and a second current signal according to the current sampling rate comprises:

performing down-sampling processing on the first current signal by using the current sampling rate; and performing down-sampling processing on the second current signal by using the current sampling rate.

4. The method according to claim 1, wherein the determining a current delay according to the processed first current signal and the processed second current signal comprises:

comparing the processed first current signal and the processed second current signal frame by frame, and determining the current delay according to a comparison result.

5. The method according to claim 4, wherein the method further comprises:

performing the step of determining the first target signal and the second target signal in the first current signal and the second current signal, respectively, according to the current delay, when the current delay is accurate.

6. The method according to claim 4, further comprising:

continuing to perform the step of comparing the processed first current signal and the processed second current signal frame by frame, and determining the current delay according to the comparison result, when the current delay is inaccurate.

7. The method according to claim 1, wherein the determining a first target signal and a second target signal in the first current signal and the second current signal, respectively, according the current delay, comprises:

according to the current delay and an error corresponding to the current sampling rate, determining the first target signal in the first current signal and determining the second target signal in the second current signal.

8. The method according to claim 7, wherein the determining the first target signal in the first current signal comprises:

determining a first position in the first current signal according to the current delay, and determining the first target signal according to the first position and the error corresponding to the current sampling rate;

the determining the second target signal in the second current signal comprises:

determining a target length of time according to the error corresponding to the sampling rate, and determining a signal that starts from a start position of the second current signal and that has a length being the target length of time as the second target signal.

9. The method according to claim 1, wherein the determining a first target signal and a second target signal in the first current signal and the second current signal, respectively, according to the current delay comprises:

performing alignment processing on the first current signal and the second current signal according to the current delay;

according to the error corresponding to the current sampling rate, determining the first target signal in the aligned first current signal, and determining the second target signal in the aligned second current signal.

10. The method according to claim 9, wherein the determining the first target signal in the aligned first current signal comprises:

determining a starting point alignment position in the aligned first current signal, and determining the first target signal according to the starting point alignment position and the error corresponding to the sampling rate;

the determining the second target signal in the aligned second current signal comprises:

determining a target length of time according to the error corresponding to the sampling rate, and determining a signal that starts from a start position of the second current signal and that has a length being the target length of time as the second target signal.

11. The method according to claim 1, wherein the determining a target delay between the recorded signal and the reference signal according to the current delay corresponding to each current sampling rate comprises:

obtaining the target delay between the recorded signal and the reference signal by performing accumulation processing on the current delay corresponding to each current sampling rate.

12. The method according to claim 1, after determining the current delay according to the processed first current signal and the processed second current signal, further comprising:

performing the step of determining the target delay between the recorded signal and the reference signal according the current delay corresponding to each current sampling rate, in a case that each of the preset sampling rates has been determined as the current sampling rate;

performing the step of determining the first target signal and the second target signal in the first current signal and the second current signal, respectively, according to the current delay, in a case that each of the preset sampling rates has been determined as the current sampling rate.

13. An apparatus for determining a delay between signals, comprising:

at least one processor; and a memory communicatively connected with the at least one processor;

wherein, the memory stores instructions executable by the at least one processor, and the instructions are executed by the at least one processor to enable the at least one processor to:

repeat following steps until each of preset sampling rates has been determined as a current sampling rate, wherein a first current signal at first is a recorded signal, and a second current signal at first is a reference signal:

determining a current sampling rate from the preset sampling rates, processing the first current signal and the second current signal according to the current sampling rate; determining a current delay according to the processed first current signal and the processed second current signal; determining a first target signal and a second target signal in the first current signal and the second current signal, respectively, according to the current delay; determining the first target signal as the first current signal, and determining the second target signal as the second current signal; and determine a target delay between the recorded signal and the reference signal according to the current delay corresponding to each current sampling rate.

14. The apparatus according to claim 13, wherein the at least one processor is further enabled to:

take a smallest preset sampling rate that has not been taken as the current sampling rate from the preset sampling rates as the current sampling rate.

15. The apparatus according to claim 13, wherein the at least one processor is further enabled to:

compare the processed first current signal and the second current signal frame by frame, and determining the current delay according to a comparison result.

16. The apparatus according to claim 13, wherein the at least one processor is further enabled to:

according to the current delay and an error corresponding to the current sampling rate, determine the first target signal in the first current signal, and determine the second target signal in the second current signal.

17. The apparatus according to claim 13, wherein the at least one processor is further enabled to:

perform alignment processing on the first current signal and the second current signal according to the current delay; and according to an error corresponding to the current sampling rate, determine the first target signal in the aligned first current signal, and determine the second target signal in the aligned second current signal.

18. The apparatus according to claim 13, wherein after determining the current delay according to the processed first current signal and the processed second current signal, the at least one processor is further enabled to:

perform the step of determining the target delay between the recorded signal and the reference signal according the current delay corresponding to each current sampling rate, in a case that each of the preset sampling rates has been determined as the current sampling rate;

perform the step of determining the first target signal and the second target signal in the first current signal and the second current signal, respectively, according to the current delay, in a case that each of the preset sampling rates has not been determined as the current sampling rate.

19. A non-transitory computer-readable storage medium storing computer instructions, wherein the computer instructions are used to enable a computer to execute the method according to claim 1.

20. A method for determining a delay between signals, comprising:

repeating following steps until each of preset sampling rates has been determined as a current sampling rate, wherein a first current signal at first is a recording signal, and a second current signal at first is a reference signal:

determining a current sampling rate from the preset sampling rates, and determining a current delay between the first current signal and the second current signal according to the current sampling rate; and according to the current delay, determining a new first current signal corresponding to the first current signal and determining a new second current signal corresponding to the second current signal; and determining a target delay between the recorded signal and the reference signal according to the current delay corresponding to each current sampling rate.

* * * * *